US010056705B2

(12) United States Patent
Starke

(10) Patent No.: US 10,056,705 B2
(45) Date of Patent: Aug. 21, 2018

(54) CABLE CONNECTION COMPONENT FOR A SHIELDED MULTI-CORE CABLE

(71) Applicant: PHOENIX CONTACT GMBH & CO. KG, Blomberg (DE)

(72) Inventor: Cord Starke, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/322,228

(22) PCT Filed: Jun. 25, 2015

(86) PCT No.: PCT/EP2015/064417
§ 371 (c)(1),
(2) Date: Dec. 27, 2016

(87) PCT Pub. No.: WO2015/197773
PCT Pub. Date: Dec. 30, 2015

(65) Prior Publication Data

US 2017/0133773 A1 May 11, 2017

(30) Foreign Application Priority Data

Jun. 27, 2014 (DE) ..... 10 2014 109 040

(51) Int. Cl.
*H01R 4/38* (2006.01)
*H01R 13/62* (2006.01)
(Continued)

(52) U.S. Cl.
CPC ..... *H01R 9/0527* (2013.01); *H01R 4/2433* (2013.01); *H01R 13/512* (2013.01);
(Continued)

(58) Field of Classification Search
CPC .. H01R 13/62; H01R 13/639; H01R 13/5829; H01R 13/512; H01R 4/2404; H01R 4/2416
(Continued)

(56) References Cited

U.S. PATENT DOCUMENTS 5,989,056 A * 11/1999 Lange ..... H01R 4/2433 439/412
6,403,884 B1 6/2002 Lange
(Continued)

FOREIGN PATENT DOCUMENTS

| | | |
|---|---|---|
| DE | 37 34 667 C1 | 3/1989 |
| DE | 198 36 622 A1 | 3/2000 |
| DE | 20 2008 004 892 U1 | 7/2008 |

OTHER PUBLICATIONS

Connection Technology for Field Devices and Field Cabling, Phoenix Contact GMBH & Co. KG, 2011 Pluscon, PDF Version, Feb. 2012, pp. 92 and 93.

*Primary Examiner* — Abdullah Riyami
*Assistant Examiner* — Thang Nguyen
(74) *Attorney, Agent, or Firm* — David S. Safran

(57) ABSTRACT

A cable connection component for electrical connection of a shielded multi-core cable, having a union nut with an internal thread, a splicing part made of insulating material and having a plurality of notches for separating the wires of the cable, and a shielding element for contacting the shielding of the cable. The splicing part has a cable holder part and a wire guiding part. The cable holder part has a plurality of latching arms facing the wire guiding part, and the wire guiding part has an inwardly projecting latching catch corresponding to the latching arms facing the cable holder part. The shielding element has an annular central section, a plurality of inner spring arms extending from the central section toward the side facing the wire guiding part, and a
(Continued)

plurality of outer spring arms extending from the central section toward the side remote form the wire guiding part.

10 Claims, 6 Drawing Sheets

(51) Int. Cl.

| | |
|---|---|
| ***H01R 9/05*** | (2006.01) |
| ***H01R 4/2433*** | (2018.01) |
| ***H01R 13/512*** | (2006.01) |
| ***H01R 13/58*** | (2006.01) |
| ***H01R 43/20*** | (2006.01) |
| ***H01R 13/52*** | (2006.01) |
| ***H01R 13/622*** | (2006.01) |
| *H01R 13/59* | (2006.01) |

(52) U.S. Cl.
CPC ..... *H01R 13/5205* (2013.01); *H01R 13/5825* (2013.01); *H01R 13/622* (2013.01); *H01R 43/20* (2013.01); *H01R 13/5829* (2013.01); *H01R 13/59* (2013.01)

(58) Field of Classification Search
USPC ..... 439/253, 389, 469, 690
See application file for complete search history.

(56) References Cited

U.S. PATENT DOCUMENTS

| | | | | |
|---|---|---|---|---|
| 8,398,419 | B2 * | 3/2013 | Coyle, Jr. ..... | H01R 13/5219 439/275 |
| 8,696,376 | B2 | 4/2014 | Andresen et al. | |
| 8,790,128 | B2 * | 7/2014 | Andresen ..... | H01R 4/2433 439/320 |
| 9,172,179 | B2 | 10/2015 | Starke et al. | |
| 9,312,629 | B2 * | 4/2016 | Smith ..... | H01R 13/625 |
| 9,490,582 | B2 * | 11/2016 | Jaschke ..... | H01R 4/2433 |
| 2013/0072050 | A1 * | 3/2013 | Andresen ..... | H01R 4/2433 439/389 |
| 2014/0179149 | A1 * | 6/2014 | Starke ..... | H01R 4/2433 439/359 |

* cited by examiner

CABLE CONNECTION COMPONENT FOR A SHIELDED MULTI-CORE CABLE

BACKGROUND OF THE INVENTION

Field of the Invention

The invention relates to a cable connection component for electrical connection of a shielded multi-core cable, comprising a union nut having an internal thread, comprising a splicing part made of insulating material and having a series of notches for separating the wires of the cable, and comprising a shielding element for making contact with the shielding of the cable. When the union nut is screwed onto an electrically conductive connecting body provided with an external thread corresponding to the internal thread, the wire insulation of the wire ends inserted into the splicing part is separated from insulation displacement terminals arranged in the connecting body and penetrating into the notches in the splicing part and the conductors of the wires are contacted.

Description of Related Art

The invention furthermore relates to a cable connection device as well as a cable link device with a cable connection component according to the invention and a device connection component or a cable link component as well as a method for assembly of a shielding element in a splicing part of a cable connection component according to the invention.

A cable connection component as part of a cable connection device is known from both German Patent DE 199 51 455 C1 and corresponding U.S. Pat. No. 6,403,884 B1 and German Patent Application DE 10 2011 108 123 A1 and corresponding U.S. Pat. No. 9,172,179 B2 with which the wires of a multi-core cable can be connected in a simple manner to the connecting elements of a device connection component or a cable link component without first requiring that the wire insulation of the individual wires be removed. In the cable connection component depicted, for example, in FIG. 6 of German Patent DE 199 51 455 C1 and corresponding U.S. Pat. No. 6,403,884 B1 and FIG. 1 of German Patent Application DE 10 2011 108 123 A1 and corresponding U.S. Pat. No. 9,172,179 B2, the individual wires of the cable are initially inserted into the splicing part which is designated there as a wire-holding and -guiding part. The wire ends are then crimped and inserted into recesses in the splicing part that serve as retaining locks for the wires during radial redirection. Subsequently, the wire ends protruding through the recesses are cut off, so that the union nut can then be screwed onto the corresponding external thread of a connecting body. When the union nut is screwed onto the connecting body, the splicing part is pressed into the connecting body, whereby the insulation displacement terminals arranged in the connecting body enter into the notches provided in the splicing part and thereby penetrate the wire insulation of the individual wires (which cross the notches) and contact the individual conductors.

Cable connection or link devices constructed in such a manner (which are already fundamentally known from German Patent DE 198 36 622 C2) have exceptionally proven their value in practice for over fifteen years and are especially extensively distributed by the applicant under the product name QUICKON® in various embodiments (cf. pages 92 and 93 of the catalogue "PLUSCON 2011" from Phoenix Contact GmbH & Co. KG).

In industrial process and measurement engineering, high interference immunity is often required. In measurement, steering, and control engineering, this immunity is a deciding factor for the availability of industrial facilities. During the setup of low-noise systems, shielded cables are being used increasingly in order to prevent capacitive and inductive electromagnetic couplings into the cable. The one end of the shielded cable is often thereby connected via a plug connector or a cable connection device to an electrical device (a sensor/actuator box, for example); the other end is connected to the supply connection via, for example, a terminal. The contacting of the cable shielding takes place on the device-side most commonly via the metallic sleeve of the plug connector or the connecting body via which the shielding is connected to the metallic housing of the electrical device.

Various options are known from practice for how the electrically conducting connection can be made between the shielding of the cable and the metallic plug sleeve of a connector which then functions as a shielding sleeve. The shielding can thereby be connected to the metallic plug sleeve either directly or via an additional shielding element. Plug connectors are known from practice in which the shielding (which is often formed as braided shielding) is directly soldered to the plug sleeve. This method of connecting the shielding to the plug sleeve involves, however, a relatively high installation cost. Furthermore, the soldering process is relatively difficult, due to the relatively large mass of the plug sleeve.

In an alternative configuration of the direct connection of the shielding to the plug sleeve, a portion of the cable sheath is removed on the free end of the cable and the shielding is pushed back over the adjacent cable sheath before the cable, thus prepared, is inserted into the plug sleeve. The plug sleeve is then deformed in the area in which the shielding has been pushed back over the cable sheath such that the shielding is clamped between the cable sheath and the plug sleeve. A direct connection of this sort of the shielding of the cable to a metallic plug sleeve is, in the previously described cable connection device or the described cable connection component, not readily possible, as the cable inside of the cable connection component is surrounded by the splicing part composed of insulating material.

As a consequence, German Utility Model DE 20 2008 004 892 U1 suggests the use of a pot-shaped shielding transfer element which has a ground and an angled collar and is pinned on the side of the splicing part that faces towards the cable to be connected. To electrically connect the shielding of the cable to the metallic plug sleeve of the device connection part, the exposed shielding of the cable is guided outwardly over the collar of the shielding element in such a way that the shielding electrically conductively contacts the plug sleeve during screwing of the union nut onto the external thread of the plug sleeve. A disadvantage of this approach is that the shielding must be placed by hand over the collar of the shielding transfer element before the wires of the cable are connected to ensure a reliable transfer of the shielding effect of the shielding.

A cable connection component (described at the outset) is known from German Patent DE 10 2010 017 265 B4 and corresponding U.S. Pat. No. 8,696,376 B2 in which a shielding element is arranged inside of the splicing part (designated there as a guidance device). The shielding element is designed as a funnel-shaped interception system which has an annular base part as well as four spring elements, bent inwardly in the direction of the longitudinal axis of the splicing part or the cable connection component. Furthermore, one of the spring elements is connected to a conducting element extending in the longitudinal direction of the cable connection component, which conducting element is inserted into the splicing part in the same manner as the wires of the cable to be connected. As the union nut is screwed onto the external thread of the connecting body, the conducting element (like the wires of the cable) is contacted by an insulation displacement terminal arranged in the connecting body. In the cable connection device known from German Patent DE 10 2010 017 265 B4 and corresponding U.S. Pat. No. 8,696,376 B2, the electrically conductive connection of the shielding of the cable thus takes place via the shielding element and the conducting element with only one of the contacts arranged in the connecting body.

SUMMARY OF THE INVENTION

The object of the invention is therefore to provide a cable connection component or cable connection device and a cable link device that make possible a simple connection of a shielded multi-core cable. Special preparation of the shielding of the cable is to be avoided thereby as much as possible.

This object is accomplished by the cable connection component of the type described at the outset in which the splicing part has a cable-holder part and a wire-guiding part, whereby the cable-holder part has, on the side facing the wire-guiding part, multiple latching arms and the wire-guiding part has, on the side facing the cable-holder part, multiple inwardly protruding latching catches corresponding to the latching arms. Furthermore, the shielding element has an annular central section, multiple inner spring arms extending from the central section in the direction of the side facing the wire-guiding part, and multiple outer spring arms extending from the central section in the direction of the side facing the wire-guiding part. The inner spring arms are thereby bent inwardly in the direction of the longitudinal axis of the cable connection component such that their ends contact the shielding of a connected cable, while the outer spring arms are bent outwardly away from the longitudinal axis of the cable connection component such that the outer spring arms extend between the cable-holder part and the wire-guiding part, whereby the ends of the outer spring arms protrude out of the splice part.

As is the case with the cable connection component known from German Patent DE 10 2010 017 265 B4 and corresponding U.S. Pat. No. 8,696,376 B2, the inner spring arms in the cable connection component according to the invention also enable the electrical contacting of the shielding of the cable. In the cable connection component according to the invention, however, the forwarding of the electrical transfer takes place not via a single conducting element to a single contact of a device connection component but rather via the outer spring arms to the metallic connecting body (functioning as a shielding sleeve) of a device connection component or a cable link component.

The two-part nature of the splicing part (it is formed of a cable-holder part and a wire-guiding part) easily creates the possibility to contact the shielding of the cable arranged in the interior of the splicing part via the shielding element on the outer circumference of the splice part. Because the shielding element has multiple external spring arms, a connection of the shielding to the metallic connecting body is made on multiple points distributed around the circumference; this is desirable for a good shield connection. Due to the flexible nature of the inner spring arms, the contacting of the shielding of the cable automatically takes place upon insertion of the cable into the cable connection component or the cable-holder part of the splice part, so that special, additional preparation of the shielding is not necessary. Rather, the connection of the shielded cable takes place in a manner known to the installer from the connection of an unshielded cable to a cable connection component known from the state of the art.

According to a preferred configuration of the cable connection component, the latching arms of the cable-holder part are arranged concentrically with respect to the longitudinal axis of the cable connection component, whereby, with the cable-holder part and the wire-guiding part mounted, a sleeve-shaped area of the wire-guiding part facing the cable connection component surrounds the latching arms. The sleeve-shaped area of the wire-guiding part is thus simply fit onto the latching arms for connection with the cable-holder part, whereby the latching arms interlock with the corresponding latching catches arranged in the interior of the sleeve-shaped area, so that the cable-holder part and the wire-guiding part are securely joined together. Because the sleeve-shaped area of the wire-guiding part surrounds the latching arms of the cable-holder part in a mounted state, the connection area between the cable-holder part and the wire-guiding part is mechanically protected; furthermore, the sealing of the wires of the cable running inside of the latching arms of the cable-holder part is improved.

As has been set forth above, the two-part nature of the splicing part makes it possible to contact the shielding (arranged in the interior of the splicing part) of the to-be-connected cable outside of the splicing part via the shielding element, namely by means of the metallic connecting body. To this end, the shielding element is arranged between the cable-holder part and the wire-guiding part, whereby according to one preferred configuration of the invention, the annular central section of the shielding element (which connects the inner spring arms to the outer spring arms) is surrounded by the latching arms of the cable-holder part—in other words, the annular central section is arranged inside of the cable-holder part. The outer spring arms of the shielding element thereby extend through the individual clearances between the latching arms of the cable-holder part. The annular central section and the latching arms of the cable-holder part are thus protected from damage during the interlocking of the cable-holder part and the wire-guiding part by the latching arms of the cable-holder part. For this purpose, it is preferable that the inner spring arms of the shielding element be correspondingly arranged with regard to the latching arms of the cable-holder part; that is, the inner spring arms and the latching arms have, in the mounted condition, the same angular position.

According to a further advantageous configuration of the cable connection component according to the invention, the inner spring arms and the outer spring arms are furthermore uniformly arranged on the circumference of the central section. This makes possible a good electrical connection of the shielding as well as a simple production of the shielding element (preferably a stamped/bent part). When, as described above, the inner spring elements are correspondingly arranged with regard to the latching arms, the outer spring arms will be arranged offset with regard to the inner spring arms, as the outer spring arms extend through the clearances between the latching arms.

In addition to the cable connection component described above, the invention also relates to an additional cable connection device for electrically conductive connection of a shielded multi-core cable to an electrical device. The electrical device can be, for example, a sensor/actuator box. Notwithstanding the above, the term "electrical device" should be understood as entirely general here—that is, other electrical components, devices, and appliances can also be encompassed by the term "electrical device."

A cable connection device of this kind has, in addition to the cable connection component described above, a device connection component which has a metallic connecting body with an external thread corresponding to the internal thread of the union nut. Furthermore, multiple insulation displacement terminals (and connecting elements associated with the individual insulation displacement terminals) are provided in the connecting body, whereby the insulation displacement terminals are arranged on the side facing the cable connection component and the connecting elements are arranged on the side facing away from the cable connection component. These are often one-piece metal parts that are configured as insulation displacement terminals on one side and as connecting elements on the other. The connecting elements can preferably be configured as male- or female contacts.

The invention at hand furthermore relates to a cable link device for the electrically conductive connection of two shielded multi-core cables. A cable link device of this type, which is often also referred to as a line connector, has, in addition to the cable connection component according to the invention, a cable link component. The cable link component has a connecting body with an external thread corresponding to the internal thread of the union nut, multiple insulation displacement terminals arranged in the connecting body, and multiple connecting elements. Just as with the device connection component, the insulation displacement terminals in the cable link device are arranged on the side facing the cable connection component and the connecting elements are arranged on the opposing side, whereby the insulation displacement terminals and the connecting elements are, in turn, electrically conductively connected with each other. For the connecting elements of the cable link component (which enable the connection of the wires of the second cable), it is possible in principle to use connection technologies familiar to one skilled in the art, such as a screw connection or a spring-cage connection. The connecting elements of the cable link component are also, however, preferably configured as insulation displacement terminals, so that multiple metal parts are arranged in the connecting body of the cable link component, which metal parts are configured on both sides as insulation displacement terminals. The connecting body then has a second external thread, onto which the union nut of a second cable connection component can be screwed, so that a splicing part can be inserted into the connecting body.

Assembly of the splicing part with the shielding element or of the shielding element in the splicing part takes place according to the invention according to a method that has the following essential steps:

Flaring of the latching arms of the cable-holder part and insertion of the shielding element between the latching arms of the cable-holder part, whereby the outer spring arms of the shielding element extend through the clearances between the latching arms;

Fitting of the wire-guiding part onto the cable-holder part, so that the latching arms on the cable-holder part catch with the latching catches on the wire-guiding part.

In the method according to the invention, the flaring of the latching arms of the cable-holder part preferably takes place with the aid of a spike which is inserted into the cable-holder part from the side facing away from the wire-guiding part. If the shielding element is inserted between the latching arms of the cable-holder part, the spike is pulled out of the cable-holder part, so that the latch arms spring back and thus radially secure the shielding element in its end position. By fitting the wire-guiding part onto the cable-holder part, both the latching connection between the wire-guiding part and the cable-holder part and the axial fixing of the shielding element are accomplished, as the free ends of the outer spring arms extend outwardly (that is, out of the splice part) between the front side of the wire-guiding part (facing the cable-holder part) and a mating stop collar on the cable-holder part.

In particular, there are now a number of possible ways to configure and further develop the cable connection component according to the invention as well as the cable connection device and the cable link device. In this respect, reference is made to the following description of a preferred embodiment in connection with the accompanying drawings.

DETAILED DESCRIPTION OF THE INVENTION

Figure 1:
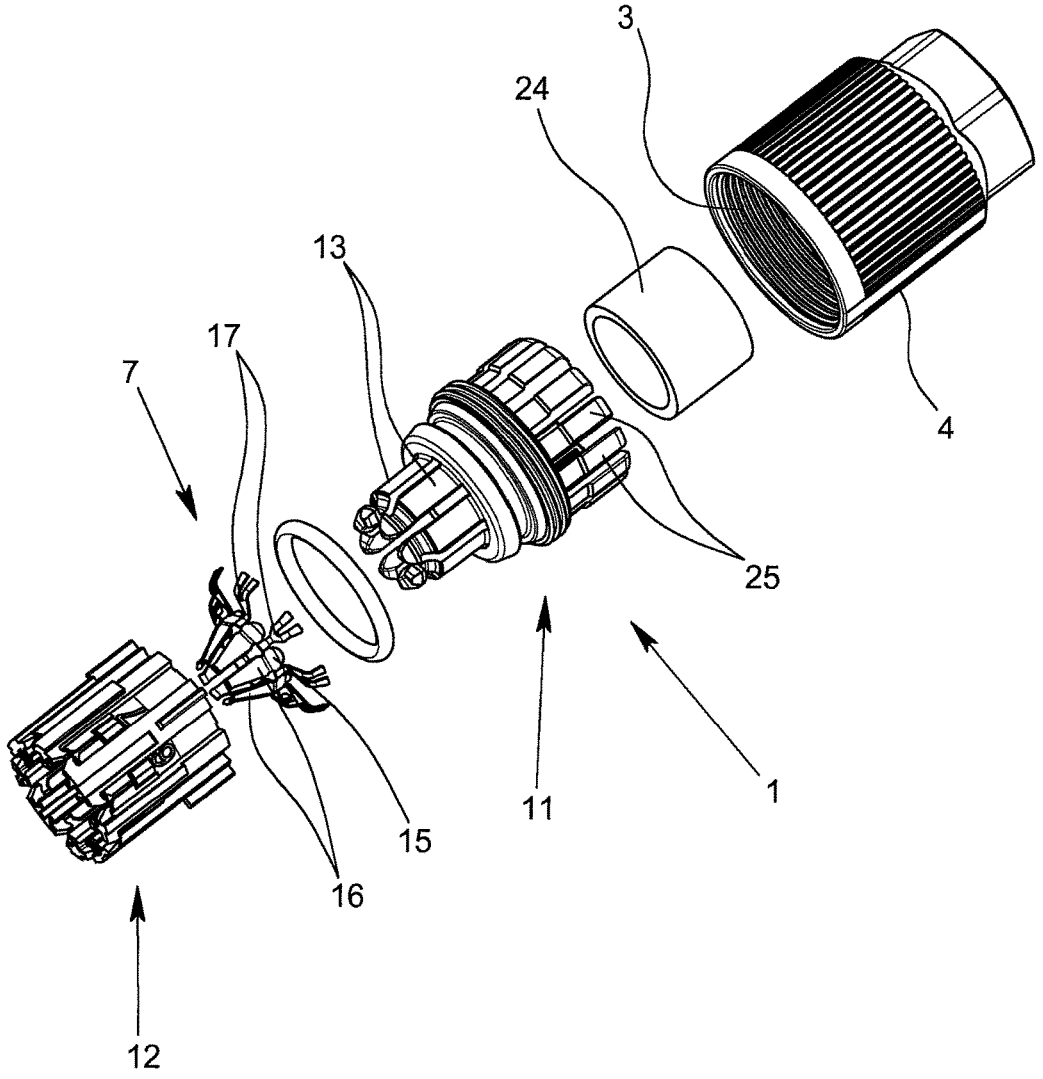
FIG. 1 is an exploded perspective view of a cable connection component.
Figure 2:
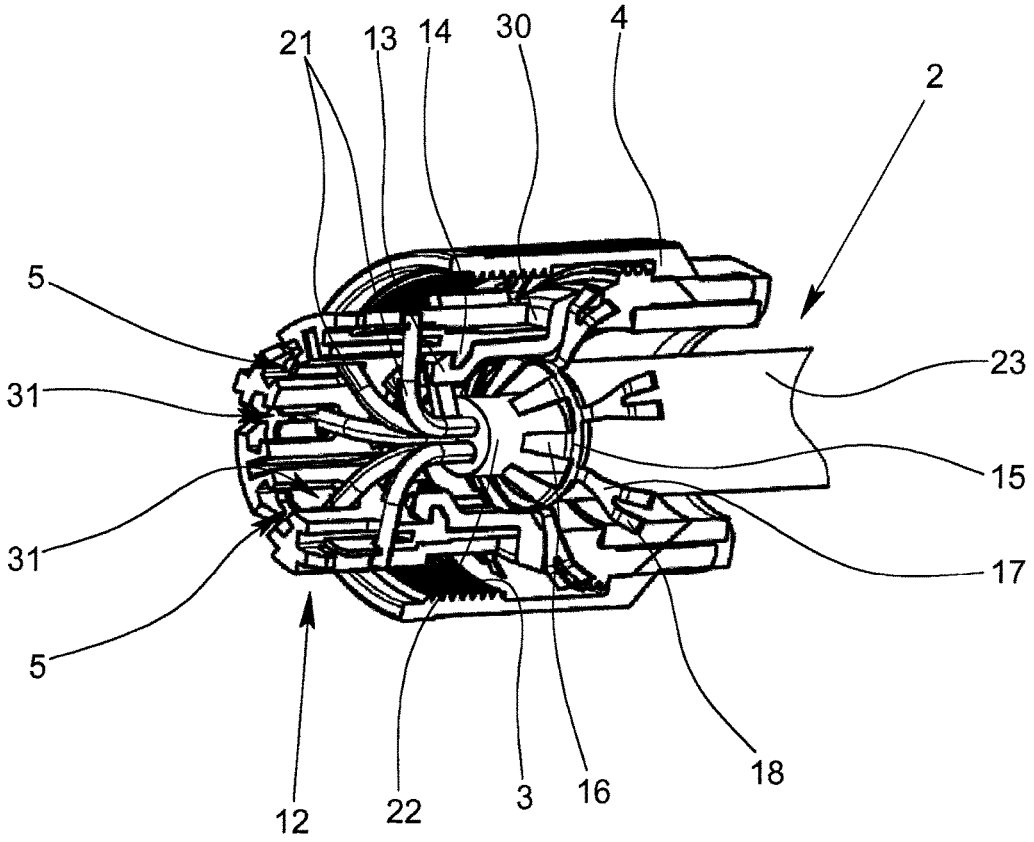
FIG. 2 is partial sectional perspective view of a cable connection component with an attached cable.
Figure 7:
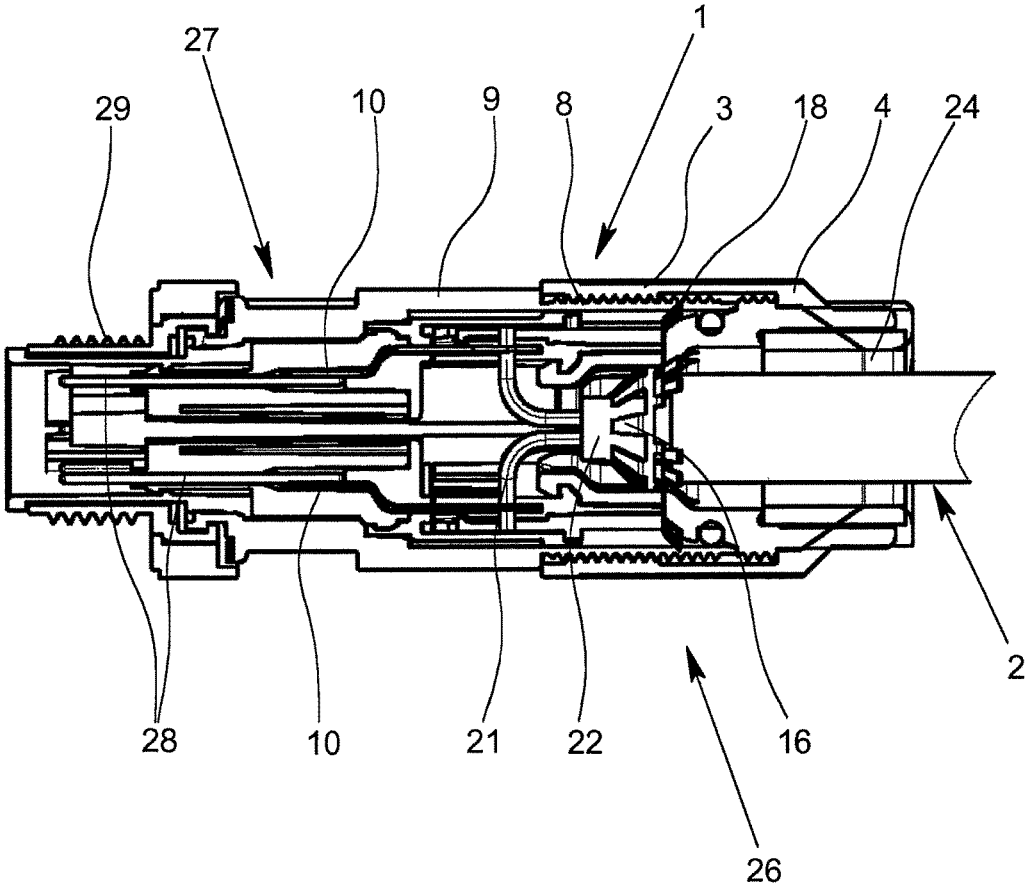
FIG. 7 is a longitudinal sectional view through a cable connection device with a cable connection component and a device connection component with attached cable.

FIG. 1 shows a cable connection component 1 according to the invention for connection of a shielded multi-core cable 2, depicted in FIGS. 2 and 7. The cable 2 has multiple wires 21, a shielding 22 which surrounds all of the wires 21, and a cable sheath 23 which surrounds the shielding 22. To the cable connection component 1 belong especially a union nut 4 which has an internal thread 3, a splicing part 6 made of insulating material comprising a series of notches 5, and a shielding element 7. If the union nut 4, with its internal thread 3, is screwed onto a corresponding metallic connecting body 9 that has an external thread 8, the splicing part 6 is pressed into the cylindrical connecting body 9, whereby the insulation displacement terminals 10 arranged in the connecting body 9 plunge into the notches 5 in the splicing part 6 and penetrate the wire insulation of the individual wires 21, which cross the notches 5, and contact the individual wires 21.

As the exploded diagram according to FIG. 1 shows, the splicing part 6 (depicted separately again in FIG. 3) comprises a cable-holder part 11 and a sleeve-shaped wire-guiding part 12 which is able to latch with the cable-holder part 11. The cable-holder part 11 has thereby a series of flexible latching arms 13, and the wire-guiding part 12 has inwardly pointing (that is, in the direction of the longitudinal axis of the wire-guiding part 12) latching catches 14 corresponding to the latching arms 13.

The shielding element 7 (depicted separately again in FIG. 1 and FIG. 6) comprises an approximately annular central section 15, a series of inner spring arms 16 extending from the central section 15 in the direction of the side facing the wire-guiding part 12, and a series of outer spring arms 17 extending from the central section 15 in the direction of the side facing away from the wire-guiding part 12. It is thereby especially clear from FIG. 2 that the inner spring arms 16 are bent inwardly in the direction of the longitudinal axis of the cable connection component 1 in such a way that the ends of the inner spring arms contact the shielding 22 of a connected cable 2. In contrast, the outer spring arms 17 are bent away from the annular central section 15—that is, away from the longitudinal axis of the cable connection component 1. With the splicing part 6 mounted, the outer spring arms 17 extend through and between the cable-holder part 11 and the wire-guiding part 12, so that the ends 18 of the outer spring arms 17 protrude outwardly from the splicing part 6.

Figure 3:
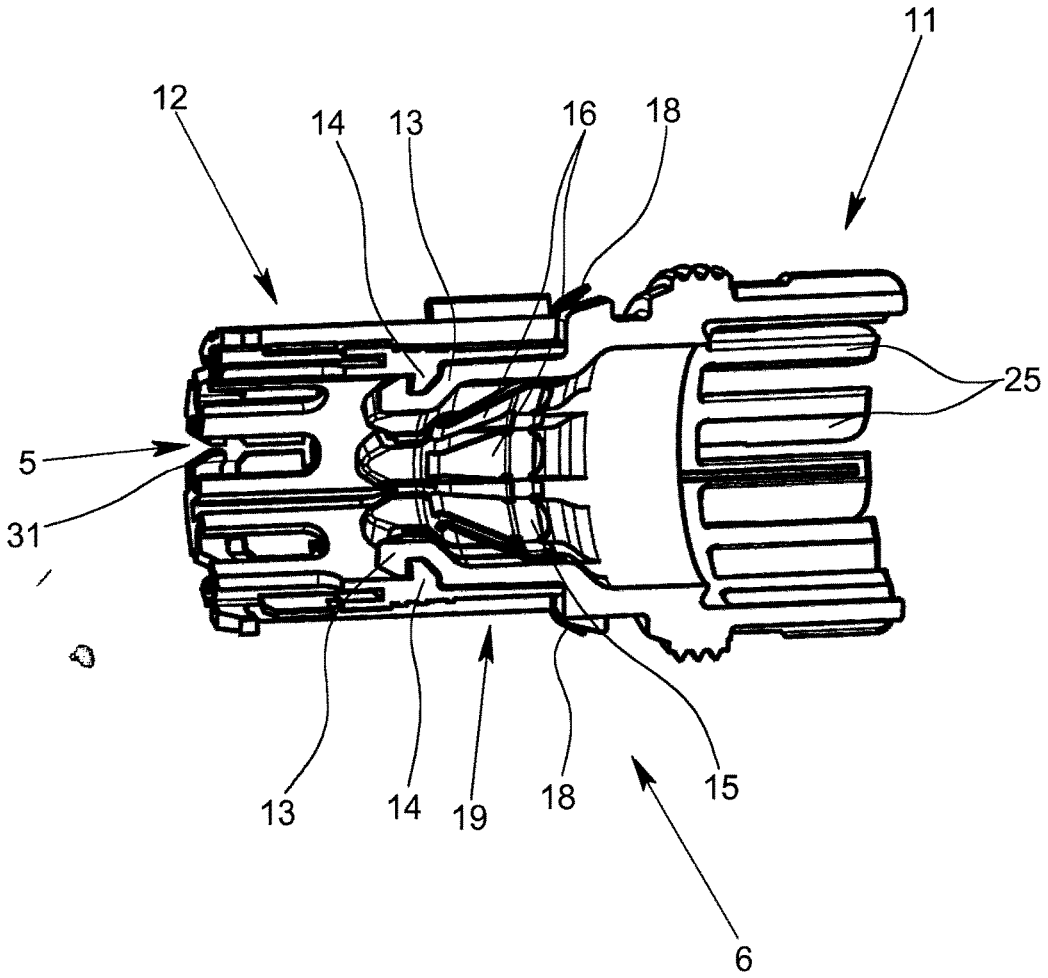
FIG. 3 is a longitudinal sectional view of the splicing part of the cable connection component according to FIG. 2 with a mounted shielding element.
Figure 4:
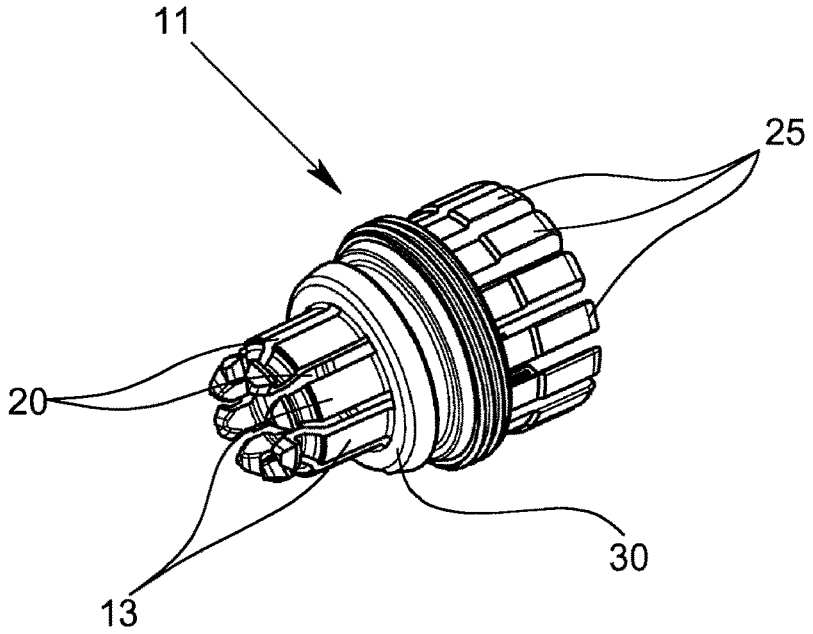
FIG. 4 is a perspective view of a separate cable-holder part.
Figure 5:
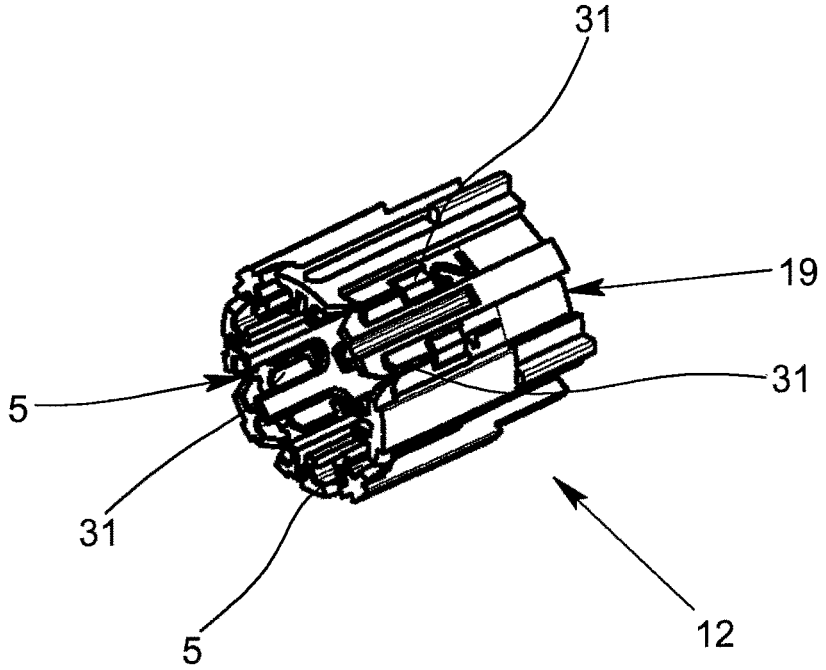
FIG. 5 is a perspective view of a separate wire-guiding part.

As is apparent from FIGS. 2 and 3, the latching arms 13, arranged concentrically to the longitudinal axis of the cable connection component 1, are, with the cable-holder part 11 and the wire-guiding part 12 mounted, surrounded by a sleeve-shaped area 19 of the wire-guiding part 12 which faces the cable-holder part 11. Because the sleeve-shaped area 19 of the wire-guiding part 12 encompasses the latching arms 13 of the cable-holder part 11, an accidental release of the latch connection between the cable-holder part 11 and the wire-guiding part 12 when the splicing part 6 is inserted into the connecting body 9 is prevented. Furthermore, this effects a secure joining of the wires 21 of the cable 2 which run inside of the latching arms 13 of the cable-holder part 11.

FIG. 3 shows the splicing part 6 in the mounted state, whereby the annular central section 15 of the shielding element 7 is arranged inside of the cable-holder part 11, namely surrounded by the latching arms 13. The outer spring arms 17 of the shielding element 7 extend thereby through the clearances 20 between the individual latch arms 13. It is thereby evident that the inner spring arms 16 as well as the outer spring arms 17 are arranged uniformly distributed about the circumference of the central section 15, whereby the inner spring arms 16 are, however, arranged offset with regard to the outer spring arms 17 in such a manner that the inner spring arms 16 have the same angular position as the latching arms 13, so that each inner spring arm 16 is covered by a corresponding latch arm 13.

Figure 6:
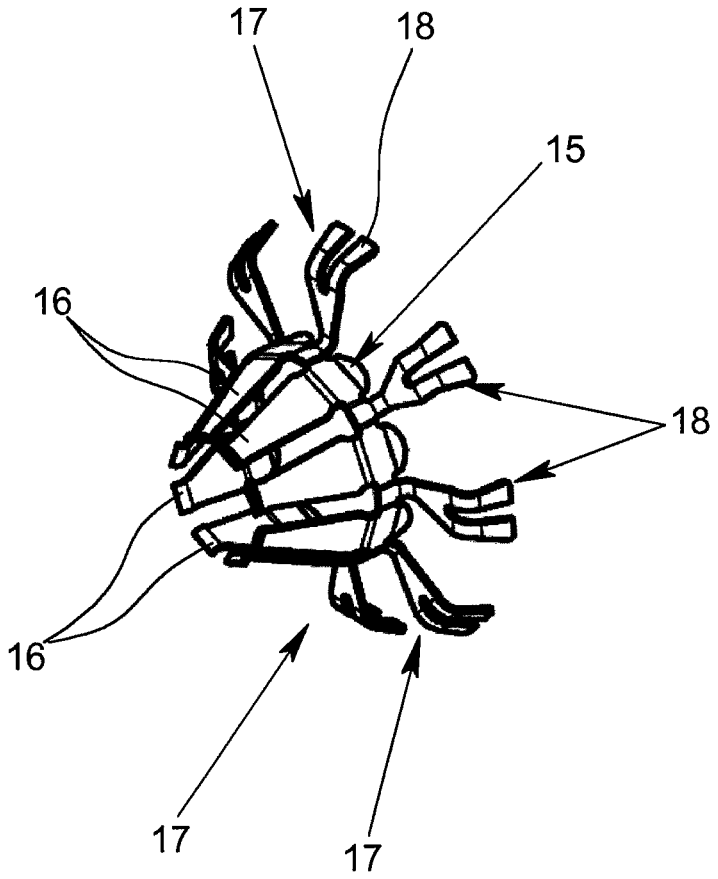
FIG. 6 is a perspective view of a shielding element.

From the enlarged depiction of the shielding element 7 according to FIG. 6, it is furthermore apparent that the width of the inner spring arms 16 decreases from the central section 15 towards their ends, whereby the ends are outwardly bent, to facilitate the contacting of the shielding 22 of the cable 2. The opening formed by the free ends of the inner spring arms 16 has a diameter that is somewhat smaller than the outer diameter of the shielding 22, so that the inner spring arms 16 are somewhat deflected when a cable 2 is inserted through the shielding element 7. By this means, a secure and good electrical contacting of the shielding 22 through the ends of the inner spring arms 16 is ensured.

While the width of the inner spring arms 16 decreases towards their ends, the width of the outer spring arms 17 increases from the central section 15 towards their ends 18, whereby the ends 18 in the depicted embodiment example are spread apart in an approximate V-shape. This ensures that the ends 18 of the outer spring arms 17 (which ends protrude outwardly out of the splicing part 6) contact the inner circumference of the metallic connecting body 9 on multiple points distributed about the circumference of the connecting body 9. Simultaneously, the cleavage of the ends 18 of the outer spring arms 17 increases the elasticity of the ends 18, which likewise positively affects the electrical connection between the ends 18 of the outer spring arms 17 and the inner surface of the metallic connecting body 9.

As is apparent from FIG. 1, the cable connection component 1 also has an annular seal 24 which, together with a series of annular lamellae 25 formed on the cable-holder part 11, forms a strain-relief- and sealing area. When the union nut 4 is screwed on, the lamellae 25 work together with a bevel in the form of an armored-thread gland provided inside the union nut 4, so that, when the union nut 4 is screwed onto the connecting body 9, the lamellae 25 are pressed against the seal 24. This simultaneously creates a sealing of and strain-relief for an inserted cable 2.

The cable connection device 26 depicted in FIG. 7 comprises a cable connection component 1 and a device connection component 27. The device connection component 27 has a metallic connecting body 9 with an external thread 8, a number of insulation displacement terminals 10 corresponding to the number of wires 21 to be connected, and connecting elements 28 electrically conductively connected to the insulation displacement terminals 10. In the present case, the connecting elements 28 are formed as male contacts which are each soldered or welded to the insulation displacement terminals 10. In the embodiment example of the cable connection device 26 depicted in FIG. 7, the device connection component 27 is formed as a connector. The connecting body 9 has, on the side facing away from the cable connection component 1, a second external thread 29 which is pivotable and can thus be screwed into a corresponding socket.

In order to assemble the splicing part 6 with the shielding element 7, the latching arms 13 of the cable-holder part 11 are first widened, so that the shielding element 7 can, with its central section 15, be inserted between the latching arms 13. The outer spring arms 17 extend thereby through the clearances 20 between the latching arms 13, so that the ends 18 of the outer spring arms 17 protrude laterally out of the cable-holder part 11. If the shielding element 7 is completely inserted between the latching arms 13 of the cable-holder part 11 and the widening of the latching arms 13 is reversed, the central section 15 will be securely fastened between the latching arms 13, so that the shielding element 7 is secured radially in its position. Next, the wire-guiding part 12, with its sleeve-shaped area 19, is fit onto the cable-holder part 11, whereby the latching catches 14 catch with the latching arms 13. Simultaneously, the sections of the outer spring arms 17 that protrude laterally out of the cable-holder part 11 are pressed against a stop collar 30 (formed on the cable-holder part 11) by the front side of the wire-guiding part 12 facing the cable-holder part 11, so that the shielding element 7 is also secured axially in its position.

To electrically conductively connect a shielded multi-core cable 2, the cable 2 is first inserted into the cable connection component 1 by inserting the end of the cable 2 through the rear opening in the union nut 4 far enough into the splicing part 6 that the individual wire ends on the front side facing away from the union nut 4 protrude out of the splicing part 6 or the wire-guiding part 12. Next, the individual wire ends are turned outwardly about 90° and pressed into the recesses 31 formed in the wire-guiding part 12 which function as restraint catches for the wire ends (cf. FIG. 2). Upon insertion of the cable 2 into the splicing part 6 or the cable-holder part 11, the shielding 22 of the cable 2 is automatically contacted by the ends of the inner spring arms 16, so that no additional steps are necessary for contacting the shielding 22 of the cable 2.

When the union nut 4 is screwed onto the external thread 8 of the metallic connecting body 9, the splicing part 6 is inserted into the connecting body 9, whereby the insulation displacement terminals 10 arranged in the connecting body 9 plunge into the notches 5 (which are arranged in the wire-guiding part 12 and which are open on the front), whereby a reliable contacting of the wire ends, which cross the notches 5 and are turned outwardly, is ensured via the insulation displacement terminals 10. Simultaneously, a flexible arrangement of the ends 18 of the outer spring arms 17 on the inner circumference of the metallic connecting body 9 is created, whereby a secure electrical connection between the shielding 22 and the metallic connecting body 9 via the shielding element 7 is ensured.

What is claimed is:

1. A cable connection component for electrically connecting a shielded multi-core cable, comprising:

a union nut having an internal thread, a splice part made of insulating material and having a series of notches for separating wires of the multi-core cable, and a shielding element for contacting shielding of the multi-core cable, wherein, when the union nut is screwed onto an electrically conductive connecting body provided with an external thread corresponding to the internal thread of the union nut, wire insulation of wire ends of the multi-core cable, when the multi-core cable is inserted into the splice part, being separated from insulation displacement terminals of the electrically conductive connecting body and penetrated into the notches in the splice part so that conductors of the multi-core cable are contacted by the insulation displacement terminals, wherein the splice part has a cable-reception part and a wire-guiding part, the series of notches being provided in the wire-guiding part, wherein the cable-reception part has a plurality of latching arms on a side which faces the wire-guiding part, and the wire-guiding part has a plurality of inwardly projecting latching catches corresponding to the latching arms on a side which faces the cable-reception part, wherein the shielding element has an annular central section, a plurality of inner spring arms extending from the central section in a direction toward the side facing the wire-guiding part, and a plurality of outer spring arms extending from the central section in a direction of a side located away from the wire-guiding part, wherein the inner spring arms are directed inward toward a longitudinal axis of the cable connection part in such a way that the ends of the inner spring arms contact the shielding of the shielded multi-core cable when connected, and wherein the outer spring arms are directed outward from the longitudinal axis of the cable connection component in such a way that the outer spring arms extend between the cable-reception part and the wire-guiding part, and the ends of the outer spring arms project out of the splice part.

2. The cable connection component according to claim 1, wherein the latching arms are arranged concentrically relative to the longitudinal axis of the cable connection component and wherein, with the cable-reception part and the wire-guiding part mounted, a sleeve-shaped area of the wire-guiding part, that faces the cable-reception part, surrounds the latching arms.

3. The cable connection component according to claim 1, wherein the annular central section of the shielding element is surrounded by the latching arms of the cable-reception part and the outer spring arms of the shielding element extend through free spaces between the latching arms.

4. The cable connection component according to claim 1, wherein the inner spring arms and the outer spring arms are arranged uniformly distributed on the circumference of the central section-shaped.

5. The cable connection component according to claim 1, wherein the inner spring arms have a width that decreases from the central section towards ends of the inner spring arms.

6. The cable connection component according to claim 1, wherein the outer spring arms have a width that increases from the central section towards their ends, whereby the ends are V- or U-shaped.

7. A cable connection device for electrically conductive connection of a shielded multi-core cable to an electrical device, comprising a device connection component and a cable connection component, wherein the cable connection component comprises:

a union nut having an internal thread, a splice part made of insulating material and having a series of notches for separating wires of the cable, and a shielding element for contacting the shielding of the multi-core cable, wherein the splice part has a cable-reception part and a wire-guiding part, the series of notches being provided in the wire-guiding part, wherein the cable-reception part has a plurality of latching arms on a side which faces the wire-guiding part, and the wire-guiding part has a plurality of inwardly projecting latching catches corresponding to the latching arms on a side which faces the cable-reception part, wherein the shielding element has an annular central section, a plurality of inner spring arms extending from the central section in a direction toward the side facing the wire-guiding part, and a plurality of outer spring arms extending from the central section in a direction of a side located away from the wire-guiding part, wherein the inner spring arms are directed inward toward a longitudinal axis of the cable connection component in such a way that the ends of the inner spring arms contact shielding of the shielded multi-core cable when connected, and wherein the outer spring arms are directed outward from the longitudinal axis of the cable connection component in such a way that the outer spring arms extend between the cable-reception part and the wire-guiding part, and the ends of the outer spring arms project out of the splice part-shaped;

wherein the device connection component comprises a metallic connecting body with an external thread, insulation displacement terminals arranged in the connecting body, and connecting elements, wherein the connecting elements and the insulation displacement terminals are connected to each other electrically conductively; and wherein, when the union nut is screwed onto an electrically conductive connecting body provided with an external thread corresponding to the internal thread of the union nut, wire insulation of wire ends of the multi-core cable is separated by the insulation displacement terminals which penetrate into the notches in the splice part so that conductors of the wires are contacted by the insulation displacement terminals when the multi-core cable inserted into the splice part.

8. A cable link device for electrically conductive connection of two shielded multi-core cables, with a cable link component and a cable connection, wherein the cable link component comprises:

a union nut having an internal thread, a splice part made of insulating material and having a series of notches for separating wires of the multi-core cable, and a shielding element for contacting shielding of the cable, wherein the splice part has a cable-reception part and a wire-guiding part, the series of notches being provided in the wire-guiding part, wherein the cable-reception part has a plurality of latching arms on a side which faces the wire-guiding part, and the wire-guiding part has a plurality of inwardly projecting latching catches corresponding to the latching arms on a side which faces the cable-reception part, wherein the shielding element has an annular central section, a plurality of inner spring arms extending from the central section in a direction toward the side facing the wire-guiding part, and a plurality of outer spring arms extending from the central section in a direction of a side located away from the wire-guiding part, wherein the inner spring arms are directed inward toward a longitudinal axis of the cable connection component in such a way that the ends of the inner spring arms contact shielding of the shielded multi-core cable when the multi-core cable is connected, and wherein the outer spring arms are directed outward from the longitudinal axis of the cable connection component in such a way that the outer spring arms extend between the cable-reception part and the wire-guiding part, and the ends of the outer spring arms project out of the splice part-shaped;

wherein the cable link component comprises a metallic connecting body with an external thread, insulation displacement terminals arranged in the connecting body, and connecting elements, whereby the connecting elements and the insulation displacement terminals are connected to each other electrically conductively; and wherein, when the union nut is screwed onto the metallic connecting body, wire insulation of wire ends of the multi-core cable is separated by the insulation displacement terminals which penetrate into the notches in the splice part so that conductors of the multi-core cable are contacted by the insulation displacement terminals when the multi-core cable is inserted into the splice part.

9. A method for assembling a shielding element in a splice part of a cable connection component comprising the following steps:

widening of latching arms of a cable-reception part and inserting a shielding element between the latching arms of the cable-reception part, whereby spring arms of the shielding element extend through free spaces between the latching arms so that conductors of the multi-core cable are contacted;

fitting a wire-guiding part onto the cable-reception part, so that the latching arms on the cable-reception part catch with latching catches on the wire-guiding part.

10. The cable connection device according to claim 7, wherein an opening is provided in alignment with the latching arms at a side of the cable reception part that faces away from the wire-guiding part for enabling insertion of a spike to spread the latching arms.

* * * * *